United States Patent [19]

Gawlick et al.

[11] 4,192,837

[45] Mar. 11, 1980

[54] CASELESS PROPELLANT CHARGE

[75] Inventors: Heinz Gawlick, Furth; Günter Marondel, Erlangen-Bruck; Werner Siegelin, Nuremberg, all of Fed. Rep. of Germany

[73] Assignee: Dynamit Nobel Aktiengesellschaft, Fed. Rep. of Germany

[21] Appl. No.: 457,609

[22] Filed: Apr. 3, 1974

[30] Foreign Application Priority Data

Apr. 3, 1973 [DE] Fed. Rep. of Germany ..... 2316548

[51] Int. Cl.[2] ..... G21C 21/00

[52] U.S. Cl. ..... 264/3 E; 149/8

[58] Field of Search ..... 264/3 R, 3 C, 3 D, 3 E; 149/8, 12, 27, 96, 97; 102/86.5

[56] References Cited

U.S. PATENT DOCUMENTS

| | | | |
|---|---|---|---|
| 1,878,621 | 9/1932 | Burns | 149/27 |
| 2,341,205 | 2/1944 | Brün | 149/27 |
| 2,885,736 | 5/1959 | O'Neill | 264/3 E |
| 3,132,585 | 5/1964 | Higashishima et al. | 149/27 X |
| 3,329,743 | 7/1967 | Coffee | 264/3 E |
| 3,463,086 | 8/1969 | Silva et al. | 149/2 X |
| 3,486,453 | 12/1969 | Smallwood | 102/86.5 |
| 3,576,926 | 4/1971 | O'Mara | 264/3 R |
| 3,658,008 | 4/1972 | Larson | 102/38 |

*Primary Examiner*—Peter A. Nelson

*Attorney, Agent, or Firm*—Craig and Antonelli

[57] ABSTRACT

A process for producing caseless propellant charges containing impact-sensitive material comprising the steps of impregnating a pre-formed propellent charge with a solution of impact-sensitive material and vaporizing the solvent from the propellent.

7 Claims, No Drawings

CASELESS PROPELLANT CHARGE

The present invention relates to caseless propellant charges wherein a priming material is provided at a predeterminable location in a propellant charge powder.

The ignition of caseless propellant charges takes place depending on the composition of the propellant charge, via a priming or primer material or by mechanical forces. In case of the use of a priming material which can, in turn, be initiated mechanically or electrically, this priming material has heretofore been produced in a separate working step and thereupon has been accommodated in prefabricated shape in an indentation or cavity of the propellant charge intended for this purpose. This mode of operation has the disadvantage that the propellant charge, customarily present in the form of a pellet, must be prefabricated so that the indentation has exactly the geometrical dimensions assumed by the priming material, and so that the priming material must be prefabricated or preformed in an additional operating step before it is bonded to the propellant charge composition. Of special disadvantage in the manufacture of such primer-containing propellant charge pellets is the fact that the priming materials are, to the largest part, very sensitive to shock and friction, so that special precautionary measures must be taken during the manufacture of such propellant charge pellets and furthermore, the finished pellets themselves must be protected against external mechanical influences.

During the ignition of propellant charges by mechanical forces, such as percussion or adiabatic compression of the air present, for example, in a cartridge chamber, there is the disadvantage that the energy required for ignition is very frequently extremely large so that the devices triggering such energies must be dimensioned correspondingly.

A process has now been found for the production of caseless propellant charges containing a priming material, which is characterized in that the priming material is allowed to penetrate or impregnate into the propellant charge material in the form of a solution and the solvent is then evaporated.

With the use of this process, the aforementioned disadvantages can be extensively eliminated, and propellant charge materials are obtained which are less sensitive to mechanical stresses than the conventional propellant charge elements containing priming material and the ignition of such impregnated charges can be effected by smaller mechanical forces.

The concentration of the priming solutions to be employed depends on the desired ignition sensitivity of the propellant charge material, which may be in the form of a pellet, cylinder, cube or the like solid body, and on the desired penetration depth into the propellant charge materials. With the use of strongly dilute solutions, the concentration of which is approximately between 0.5 and 10% by weight (i.e., the solution contains 0.5 to 10% by weight of the dissolved priming material), it is advantageous to impregnate several times with the primer solution. If solutions are used which are more concentrated or saturated, a single impregnating step is often sufficient.

Water is preferably utilized as the solvent, particularly if the selected primer materials are water-soluble. However, it is likewise possible to employ low-boiling organic solvents having boiling points of up to 100° C., under the condition that these do not locally alter the percentage composition of the propellant charge powder (i.e. the relative proportions of ingredients)—in case of propellant charge powders having a complicated constitution.

Suitable organic solvents, are for example, alcohols and esters.

An example of a suitable priming solution is a solution of diazodinitrophenol or 5-aminotetrazole in ethyl alcohol.

The priming materials preferably utilized are the alkali metal and alkaline earth metal salts of picric acid or of ammonium picrate, as well as alkali chlorates. These salts can be directly used as aqueous solutions.

It is, however, also possible according to the invention to allow an impact-sensitive priming compound to be formed only within the body of the propellant charge material by dripping the corresponding reaction components, in a solution, successively on the body of the propellant charge material. This mode of operation is advantageous especially if the intended priming composition is hard to dissolve. Thus, with the use of tetrazene as the priming compound, for example, the procedure is such that, successively, a solution of an aminoguanidine salt (e.g. aminoguanidine sulfate) and a solution of sodium nitrite (or of another alkali metal nitrite) is dripped into the body of the propellant charge material at a predetermined location. The concentrations of the two solutions must, of course, be adapted to each other so that the amounts are applied which can react with each other. In case of tetrazene, two moles of the aminoguanidine salt is applied by this dripping step per mole of alkali metal nitrite.

In this way, it is also possible to apply shock-sensitive salts of polynitrophenols to the propellant charge substance by dropping thereon successively equivalent amounts of a solution of the polynitrophenol and a water-soluble salt of the desired metal component. Polynitrophenols which can be used in this connection are picric acid, trinitroresorcinol, trinitrophloroglucine, or dinitroresorcinol, wherein the latter can also be used in the form of a sodium salt. Primarily suitable as the metallic component is lead nitrate or barium nitrate; however, other water-soluble salts of these metals can also be utilized.

It is also possible to premix one of the reaction components with the propellant charge powder and, after the shaped element has been produced, drip onto this mixture the second reaction component at a specific location.

Suitable propellant charge elements or bodies are pressed or extruded articles of nitrocellulose or double-base or triple-base propellants. Moreover, secondary explosives or compounds with a high nitrogen content (50–87% $N_2$) can be utilized, which are embedded in a polyurethane matrix or a matrix of another synthetic resin.

EXAMPLE I

Four drops of a 20% aqueous ammonium picrate solution are applied in the center of a caseless propellant charge pellet having a diameter of 9.5 mm, made of fibrous nitrocellulose with a nitrogen content of 13.4%. The caseless propellant charge is dried for four hours at 80° C. in a drying chamber. When tested for percussion sensitivity in a special testing device, 70 to 120 cm-kp is determined for a 100% conversion, i.e. detonation, of the untreated pellet. In contrast, the treated pellet attains complete conversion at an impact energy of 35 cm.kp.

EXAMPLE II

In a manner similar to Example I, an identical pellet is treated with five drops of a solution of 14.7 g. of trinitroresorcinol in 100 ml. of water, and then is dried. Thereafter, five drops of a solution of 20 g. of lead nitrate in 100 ml. of water are applied at the same point where the resorcinol solution had been applied; then, the pellet is dried. The percussion energy required for the complete conversion of the pellet is 20 cm. kp. in the same testing device utilized in Example I.

While the novel embodiments of the invention have been described, it will be understood that various omissions, modifications and changes in these embodiments may be made by one skilled in the art without departing from the spirit and scope of the invention.

What is claimed is:

1. A process for the manufacture of caseless propellant charges containing a priming material, which comprises impregnating a preselected outer portion of a prefabricated charge formed into a shaped body with a solution of priming material in a solvent, and thereafter, vaporizing the solvent from said propellant charge to provide said priming material as a primer charge within said propellant charge.

2. A process for the manufacture of caseless propellant charges containing impact-sensitive material which comprises applying reaction components to be utilized for the production of the impact-sensitive material each in drops successively as a solution containing a solvent onto a specific point of a body of the propellant charge in the quantities equivalent for the formation of impact-sensitive material within the body of said propellant charge and thereafter removing solvent from said body.

3. A process for the manufacture of a caseless propellant charge containing an impact-sensitive material, which comprises premixing one reaction component to be utilized for the production of an impact-sensitive material with the propellant charge in the form of powder and thereafter, upon completion of the shaping of said charge, into a solid body, dripping a second reaction component onto a predetermined location of said body to form the impact-sensitive material within said body and thereafter drying said body.

4. The process according to claim 1, wherein said solvent is vaporized by the application of heat.

5. The process according to claim 1, wherein the priming material is water-soluble and said solvent is water.

6. The process according to claim 1, wherein the body of the propellant charge is a compressed powder.

7. A caseless propellant charge comprising a body preformed of powder of propellant charge material, said body containing a priming material impregnated throughout a preselected outer portion of said body, said body being a cylindrical pellet and the priming material being impregnated onto the center of said pellet.

* * * * *